US007490728B2

(12) United States Patent
Schobesberger

(10) Patent No.: US 7,490,728 B2
(45) Date of Patent: Feb. 17, 2009

(54) CRANE

(75) Inventor: Eugen Schobesberger, Nenzing (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 31 days.

(21) Appl. No.: 11/486,869

(22) Filed: Jul. 14, 2006

(65) Prior Publication Data

US 2007/0017889 A1 Jan. 25, 2007

(30) Foreign Application Priority Data

Jul. 25, 2005 (DE) ..... 10 2005 034 677

(51) Int. Cl.
*B66C 23/53* (2006.01)

(52) U.S. Cl. ..... 212/308; 212/278

(58) Field of Classification Search ..... 212/278, 212/308

See application file for complete search history.

(56) References Cited

U.S. PATENT DOCUMENTS

| | | | | |
|---|---|---|---|---|
| 3,799,505 | A | 3/1974 | Duncan | 254/173 |
| 4,025,055 | A | 5/1977 | Strolenberg | 254/172 |
| 4,132,387 | A | 1/1979 | Somerville et al. | 254/173 |
| 4,180,362 | A | 12/1979 | Stair | 414/139 |
| 4,782,961 | A * | 11/1988 | Lange | 212/308 |
| 4,787,524 | A * | 11/1988 | Cobb et al. | 212/278 |
| 6,505,574 | B1 * | 1/2003 | Naud et al. | 114/268 |
| 7,367,464 | B1 * | 5/2008 | Agostini et al. | 212/308 |

FOREIGN PATENT DOCUMENTS

| | | |
|---|---|---|
| DE | 3418026 A 1 | 11/1985 |
| DE | 196 45 812 C 1 | 2/1998 |
| DE | 202 19 282 | 4/2004 |
| EP | 0 033 239 | 8/1981 |
| EP | 0 779 239 | 6/1997 |
| GB | 2 132 972 A | 7/1984 |

* cited by examiner

*Primary Examiner*—Thomas J. Brahan
(74) *Attorney, Agent, or Firm*—Allston L. Jones

(57) ABSTRACT

A crane, in particular to an offshore crane, having a hoist rope winch, a hydraulic hoist winch drive and an overload protection which is connected to the hoist winch drive and which, when a predetermined permitted limit load is reached, permits a drawing off of the hoist rope from the hoist rope winch under a predetermined variable restoring force dependent on the radius and/or the permitted working load of the crane. A decoupling of the hoist winch drive and thus a mechanical separation of the powertrain between the hoist rope winch and the hoist winch drive is therefore dispensed with and instead the retention force varying in dependence on the radius and/or the respectively permitted working load of the crane is provided by the hoist rope winch drive motor.

29 Claims, 2 Drawing Sheets

CRANE

BACKGROUND OF THE INVENTION

1. Field of the Invention

The present invention relates to a crane, in particular to an offshore crane, having a hoist rope winch, a hydraulic hoist winch drive and an overload protection which is connected to the hoist winch drive and which, when a predetermined permitted load limit is reached, permits a drawing off of the hoist rope from the hoist rope winch under a predetermined variable restoring force dependent on the radius and/or the permitted working load of the crane.

2. Description of the Prior Art

As a rule, cranes have an overload protection with a control device which prevents the crane from being moved into the overload range. In this process, the load acting on the crane is detected by means of a load detection device and is compared with a load limit. As soon as too great a load should be lifted or the radius should be increased so much by luffing down the crane boom with a lifted load that the load limit would be reached, the control device of the crane engages and sets the crane drives out of operation or only allows an actuation to the effect that the load acting on the crane is reduced. The load limit can be stored in the form of a load limit curve typical per se in dependence on the crane radius for various setup conditions. It has also already been proposed to define the load limit as a torque limit and always to make a current calculation of the load torque respectively acting on the crane from the respective radius and the winch rope force.

This type of overload protection is, however, not suitable for all possible load cases. Load cases can in particular occur with offshore cranes in which the mere switching off of the crane drives would result in a destruction of the crane. The loading and unloading of a ship, which is not carried out with calm water in a port, but at a higher sea state, is particularly dangerous here if the lifting hook of a crane standing on an offshore platform is attached onto too heavy a load which lies on a ship, an overload of the crane occurs when the ship sinks into a wave trough. The case is even more dangerous when the lifting hook of the crane catches on a component fixed to the ship body and the ship then sinks into a larger wave trough or moves away. The loads which occur would result in a destruction of the crane if the overload protection only sets the actuator units of the crane out of operation. To prevent a destruction of the crane in such cases, the hoist rope must be paid out.

It has already been proposed in such cases in which the load limit of the crane is reached by a pulling away of the lifting hook to actuate the hoist winch drive using the control device of the crane such that the hoist winch unwinds the hoist rope. The limited speed of the hoist winch drives used to date, however, restricts this form of overload protection to moderate wave conditions. With a very rough sea with high waves, overload cases can occur in which the ship to be loaded or unloaded sinks into a wave trough so fast that load peaks lying above the damage load of the crane are achieved.

It has furthermore already been proposed to provide a coupling between the hoist rope winch and the hoist rope winch drive motor and to decouple the hoist winch when the load limit is exceeded to permit the hoist rope to be paid out at high speed. In this connection, the retaining force of the hoist rope winch can be controlled using a hoist rope brake so that a hoist rope force is maintained with a decoupled coupling which corresponds to the load limit of the crane (cf. DE 202 19 282 U1). This solution with decoupling of the hoist rope winch and thus separation of the mechanical powertrain between the hoist winch drive and the hoist winch, however, occasionally encounters safety concerns. In addition, the coupling and brake to be installed and their controlling in dependence on various load and position sensors make the hoisting gear and its overload protection relatively complex.

SUMMARY OF THE INVENTION

It is therefore the underlying object of the present invention to provide an improved crane of the said kind which avoids disadvantages of the prior art and further develops the latter in an advantageous manner. A fast responding overload protection should preferably be provided which permits an extending of the hoist rope with a variable retention force adapted to the respectively applicable working load without separation of the mechanical powertrain between the hoist rope winch and the hoist rope winch drive.

This object is solved in accordance with the invention by a crane in accordance with claim 1. Preferred aspects of the invention form the subject of the dependent claims.

A decoupling of the hoist winch drive and thus a mechanical separation of the powertrain between the hoist rope winch and the hoist winch drive is therefore dispensed with and instead the retention force varying in dependence on the radius and/or the respectively permitted working load of the crane is provided by the hoist rope winch drive motor. In accordance with the invention, the overload protection has a controllable balance valve which is associated with the hoist winch drive motor and is controlled by a control device such that the pressure applied to the hoist winch drive motor in the overload case varies in accordance with the desired retention force in dependence on the radius and/or the respectively permitted working load of the crane. The invention starts from the consideration that the retention force is directly proportional to the pressure in the hoist winch drive so that a hydraulic control of the winding off of the hoist rope can take place by control of the pressure applied to the hoist winch drive motor. The balance valve in particular works so-to-say as a discharge valve on the hoisting side of the hoist winch drive motor such that hydraulic fluid is discharged on the hoisting side of the hoist winch drive motor under a presettable pressure—which varies in the desired manner in accordance with the maximum permitted working load applicable to the respective crane configuration and position—and the winch can thus be unwound under a corresponding resistance.

The control of the balance valve can in particular be varied in dependence on a respectively current radius of the crane and/or in dependence on the respective load limit or permitted working load of the crane. The overload protection can have a radius determination device for the determination of the respectively current radius of the crane and/or a working load determination device for the determination of the permitted working load, for example while making use of a working load curve. The control device then controls the balance valve in dependence on a signal of the radius determination device and/or of a signal of the working load determination device to vary the pressure applied to the hoist winch drive motor in the overload case and thus to vary the desired retention force in dependence on the radius and/or on the respectively permitted working load of the crane.

In a further development of the invention, the opening of the balance valve is controlled hydraulically via a pilot pressure connected to the balance valve. The control device controlling the balance valve can have a proportional pressure-relief valve for this purpose whose outlet pressure is connected to the balance valve as the control pressure.

The named proportional valve can itself be controlled differently. In accordance with an advantageous embodiment of the invention, the overload protection can have a radius detection device with whose help the radius of the crane, that is the lever arm of the lifting hook with respect to the crane contact point, is detected. The control device then controls the proportional valve in dependence on the respectively detected radius such that the desired control pressure is adopted for the balance valve and thus the desired balancing pressure is adopted on the hoisting side of the hoist winch drive motor.

In a further development of the invention, the position of the proportional pressure relief valve can also be regulated by a suitable regulator. The overload protection can comprise a balance pressure detection device with whose help the control pressure adopted at the outlet side of the proportional valve and/or the balance pressure is detected directly on the hoisting side of the hoist winch drive motor. The position of the proportional valve is correspondingly regulated in dependence on the respectively detected and respectively desired balance pressure.

The pressure-relief valve can generally be made variously and arranged variously. Provision can generally be made for the discharge side of the pressure-relief valve to be connected to a tank of the system so that pressure fluid discharged from the hoisting side of the hoist winch drive is returned to the tank of the system. In accordance with an advantageous embodiment of the invention, however, the pressure-relief valve is arranged between the hoisting side and the lowering side of the hoist winch drive motor. In the open state, the pressure-relief valve short circuits the hoisting side and the lowering side of the hoist winch drive motor so that pressurized oil is discharged on the hoisting side of the hoist winch when winding off the hoist rope at the desired retention force is fed back in again on the lowering side of the hoist winch.

The pressure-relief valve can itself have different designs. In accordance with an advantageous embodiment of the invention, it can be made as a valve cartridge or a so-called cartridge pressure valve and/or have a conical valve seat.

Furthermore, in a further development of the invention, the overload protection of the crane can comprise an on/off valve which activates the overload protection function in the energy-charged state but blocks the balance valve in the non-energy charged state. A path detection device, in particular a position detection switch, can be associated with the on/off valve to monitor the switching position of the on/off valve and thus to permit error detection.

The present invention relates to a crane, in particular to an offshore crane, having a hoist rope winch, a hydraulic hoist winch drive and an overload protection which is connected to the hoist winch drive and which, when a predetermined permitted limit load is reached, permits a drawing off of the hoist rope from the hoist rope winch under a predetermined variable restoring force dependent on the radius and/or the permitted working load of the crane. A decoupling of the hoist winch drive and thus a mechanical separation of the powertrain between the hoist rope winch and the hoist winch drive is therefore dispensed with and instead the retention force varying in dependence on the radius and/or the respectively permitted working load of the crane is provided by the hoist rope winch drive motor. In accordance with the invention, the overload protection has a controllable balance valve which is associated with the hoist winch drive motor and is controlled by a control device such that the pressure applied to the hoist winch drive motor in the overload case varies in accordance with the desired retention force in dependence on the radius and/or the respectively permitted working load of the crane. The invention starts from the consideration that the retention force is directly proportional to the pressure in the hoist winch drive so that a hydraulic control of the winding off of the hoist rope can take place by control of the pressure applied to the hoist winch drive motor. The balance valve in particular works so-to-say as a discharge valve on the hoisting side of the hoist winch drive motor such that hydraulic fluid is discharged on the hoisting side of the hoist winch drive motor under a presettable pressure—which varies in the desired manner in accordance with the maximum permitted working load applicable to the respective crane configuration and position—and the winch can thus be unwound under a corresponding resistance.

The invention will be explained in more detail in the following with respect to a preferred embodiment and to associated drawings. There are shown in the drawings:

DETAILED DESCRIPTION OF THE INVENTION

Figure 1:
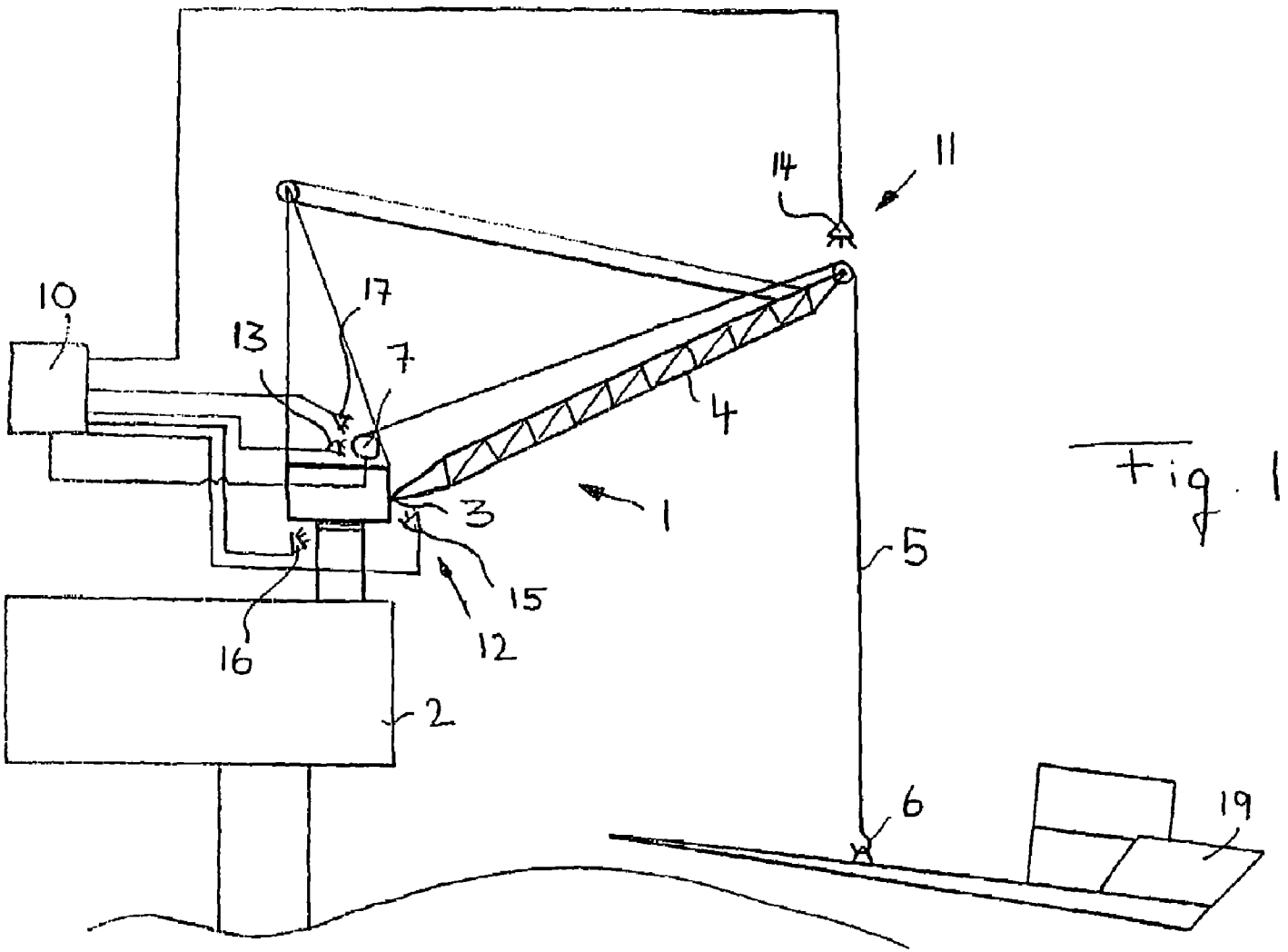
FIG. 1: a schematic representation of an offshore crane, which is installed on an offshore platform and is unloading a container ship in a sea state, with an overload protection in accordance with a preferred embodiment of the invention.
Figure 2:
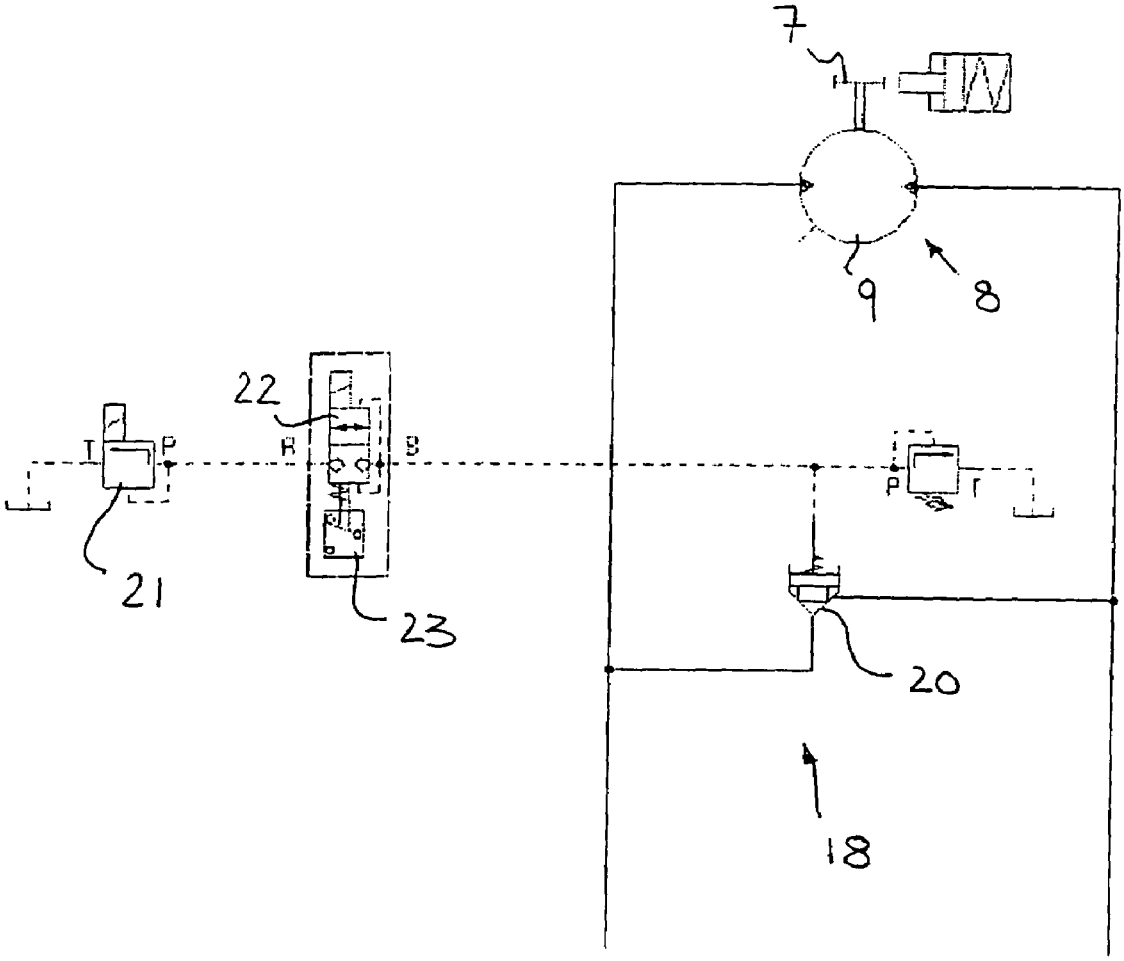
FIG. 2: a schematic representation of the circuit of the hydraulic components of the overload protection of the crane of FIG. 1.

The crane drawn in FIG. 1 is rotatably supported on an offshore platform 2 by means of a rotating mechanism around a vertical axis. It has a boom 4 luffable around a horizontal luffing axis 3, with a hoist rope 5 which carries a lifting hook 6 running off over the tip of said boom. The hoist rope 5 can be paid out and hauled in by means of a hoist winch 7 which is fixedly supported on the rotatable steel construction body of the crane. As FIG. 2 shows, the hoist rope winch 7 is driven by a hoist winch drive 8 comprising a hydraulic hoist winch drive motor 9 which is controlled by a control device 10 of the crane 1.

As FIG. 1 shows, the control device 10 is connected to a load detection device 11 and to a lifting hook position detection device 12 which, on the one hand, detect the respective load acting on the crane 1 and, on the other hand, detect the respective position of the lifting hook 6. The load detection device 11 in the drawn embodiment comprises a hoist rope force sensor 13 which detects the force acting in the hoist rope 5 and a radius sensor 14 which detects the radius of the crane 1, i.e. the horizontal spacing of the hoist rope 5 running off from the tip of the boom 4 from the vertical axis of rotation of the crane 1.

The lifting hook position detection device 12 likewise comprises a plurality of sensors, in the drawn embodiment a luffing angle sensor 15 which detects the respective luffing angle of the boom 4, furthermore a rotational angle sensor 16 which detects the angle of rotation of the crane with respect to its vertical axis of rotation and finally a hoist rope length sensor 17 which detects the length of the hoist rope unwound from the winch and can be made as a rotational position sensor which detects the rotational position of the hoist rope winch 7. All sensors are connected to the control device 10 which determines the load currently acting on the crane, on the one hand, and the respectively current position of the lifting hook 6, on the other hand, from the different signals During normal operation, the crane control monitors the load respectively acting on the crane in a manner known per se and ensures that the actual load does not rise above the permitted load limit. If, for example, a load is raised and the radius is increased by luffing down the boom 4 so that a lower permitted load limit is to be set, the control device 10 prevents a further luffing down of the boom 4 and stops the luffing mechanism of the crane in advance.

The crane, however, furthermore comprises a special overload protection 18 (see FIG. 2) for special load cases in which the permitted load limit of the crane is nevertheless reached: If, for example, the lifting hook 6 of the crane 1 cat chesat a fixed component of a ship 19 bobbing up and down in the waves (cf. FIG. 1), a switching off of the crane drives is not sufficient to keep the load under the permitted load limit.

If the actual load acting on the crane reaches the permitted load limit or if it even exceeds it in such a case, the overload protection 18 shown in FIG. 2 permits a drawing off of the hoist rope 5 under a predefined retention force which is adapted variably to the respective crane configuration and crane radius and is in particular set to the permitted load limit.

As FIG. 2 shows, the hoisting side of the hydraulic hoist winch drive motor 9 is connected to a balance valve 20 which, in the drawn embodiment, is a so-called cartridge pressure valve having a conical valve seat area and is connected to the lowering side of the hoist winch drive motor 9 at its outlet. In the open state of the balance valve 20, the hoisting side of the hoist winch drive motor 9 is thereby short circuited with its lowering side so that pressurized oil from the hoisting side can flow onto the lowering side and the hoist winch 7 can thereby be unwound with a predetermined resistance. The retention force acting on the hoist rope 5 is directly proportional to the system pressure which is determined by the balance valve 20 and which is applied at the hoisting side of the hoist winch drive motor 9.

The opening of the balance valve 20 and thus the balance pressure applied to the hoisting side of the hoist winch drive motor 9 is hydraulically controlled. A variable control pressure which is connected to the balance valve 20 is generated via a proportional pressure-relief valve 21. The proportional valve 21 is in particular controlled by the control device 20 in dependence on the radius of the crane detected by the radius sensor 14 so that the opening of the balance valve 20 is determined and thus the balance pressure applied on the hoisting side of the hoist winch drive motor 9 and thus the retention force generated in the hoist rope 5 in dependence on the crane radius and thus the respectively permitted load limit.

In a further development of the invention, the proportional valve 21 can also be regulated by a regulator. The proportional valve 21 is in particular automatically regulated such that the retention force measured by the hoist rope force sensor 13 corresponds to the respectively permitted working load.

FIG. 2 additionally shows an on/off valve 22 which is provided in the control pressure line between the proportional valve 21 and the balance valve 20. This on/off valve 22 is made such that it has to be charged with energy to activate the system. As FIG. 2 shows, a position sensor or position switch 23 is associated with the on/off valve 22 which indicates the position of the on/off valve 22 and is monitored by the system so that an error monitoring is made possible.

The overload protection 18 can, for example, be deactivated when the lifting hook 6 is located above the platform 2. On the other hand, the overload protection 18 can be activated and the drawing off of the rope can be permitted under the predefined retention force when the lifting hook 6 is located beneath the plane of the platform 2 in a position in which it can be hooked to a ship 19 or the like.

While the invention has been described with regard to a several specific embodiment, those skilled in the art will recognize that changes can be made in form and detail without departing from the spirit and scope of the invention in the form of an equivalent device. Thus the claims provided herewith are intended to cover the invention as described herein and equivalents there to.

What is claimed is:

1. A crane having:

a hoist rope winch (7);

a hoist rope (5) with a proximate end attached to, and partially wound around, the hoist rope winch (7);

a lifting hook (6) attached to the hoist rope (5) and disposed to be attached to an object to be lifted or lowered;

a hydraulicly operated hoist winch drive motor (9) coupled to the hoist rope winch (7) to drive same; and an overload protection (18) includes:

a controllable balance valve (20) disposed to receive hydraulic pressure from a control pressure line and distribute the hydraulic pressure between first and second hydraulic input ports of the hydraulic hoist winch drive motor (9) to reel the hoist rope (5) on and off the hoist rope winch (7) under a predetermined variable retention force; and a control device (10) disposed to retain a value of a permitted load limit for each potential crane radius and to determine a current radius of, and load on, the crane and being coupled to overload protection (18);

wherein, when the predetermined permitted load limit is reached for the then current radius of the crane the control device (10) controls the controllable balance valve (20) to distribute the hydraulic pressure between the first and second hydraulic input ports of the hydraulic hoist winch drive motor (9) to permit drawing off the hoist rope (5) from the hoist rope winch (7) under a predetermined variable hoist rope retention force.

2. The crane in accordance with claim 1, wherein overload protection (18) further includes a proportional pressure-relief valve (21) that is connected between a hydraulic pressure source and the control pressure line to provide a controlled hydraulic pressure to the balance valve (20) under control of control device (10).

3. The crane in accordance with claim 2, wherein the overload protection (18) further includes an on/off valve (22) in the control pressure line between the proportional pressure-relief valve (21) and the balance valve (20) to block the application of hydraulic pressure to the balance valve (20) it is in a non-controlled state.

4. The crane in accordance with claim 3, wherein a position detection switch (23) is associated with the on/off valve (22).

5. The crane in accordance with claim 2, wherein the overload protection (18) has a working load determination device for the determination of the permitted working load of the crane and the proportional pressure-relief valve (21) is controllable by the control device (10) in dependence on the respectively determined permitted working load of the crane.

6. The crane in accordance with claim 2, wherein the overload protection (18) has a retention force detection device (13) and the proportional pressure-relief valve (21) can be regulated by a regulator in dependence on the respectively detected retention force and the respectively desired retention force.

7. The crane in accordance with claim 2, wherein the balance valve (20) in the open state short circuits the first and second hydraulic input ports of the hoist winch drive motor (9) resulting in the same hydraulic pressure being applied to both ports.

8. The crane in accordance with claim 2, wherein the balance valve (20) is made as a valve cartridge with a conical valve seat.

9. The crane in accordance with claim 2, wherein the overload protection (18) has further includes a radius detection device (14) with the proportional pressure-relief valve (21) controlled by the control device (10) in dependence on the respectively detected radius of the crane.

10. The crane in accordance with claim 9:

the overload protection (18) further includes a hoist rope force sensor (13); and wherein the control device (10) in dependence on the respectively detected hoist rope force and the respectively desired hoist rope retention force controls the proportional pressure-relief valve (21) to output a desired hydraulic pressure on the control pressure line.

11. The crane in accordance with claim 9, wherein the balance valve (20) in the open state short circuits the first and second hydraulic ports of the hoist winch drive motor (9) resulting in the same hydraulic pressure being applied to both ports.

12. The crane in accordance with claim 9, wherein the balance valve (20) is made as a valve cartridge with a conical valve seat.

13. The crane in accordance with claim 9, wherein the overload protection (18) further includes an on/off valve (22) in the control pressure line between the proportional pressure-relief valve (21) and the balance valve (20) to block the application of hydraulic pressure to the balance valve (20) it is in the a non-controlled state.

14. The crane in accordance with claim 1 the overload protection (18) further includes:

a working load detection device (11) that is coupled to the control device (10) permitted; and a proportional pressure-relief valve (21) that is connected between a hydraulic pressure source and the control pressure line to provide a controlled hydraulic pressure to the balance valve (20);

wherein the control device (10) in dependence on the detected load on the crane controls the proportional pressure-relief valve (21) to output a desired hydraulic pressure on the control pressure line.

15. The crane in accordance with claim 14:

The overload protection (18) further includes a hoist rope force sensor (13); and wherein the control device (10) in dependence on the respectively detected hoist rope force and the respectively desired hoist rope retention force controls the proportional pressure-relief valve (21) to output a desired hydraulic pressure on the control pressure line.

16. The crane in accordance with claim 14, wherein the balance valve (20) in the open state short circuits the first and second hydraulic ports of the hoist winch drive motor (9) resulting in the same hydraulic pressure being applied to both ports.

17. The crane in accordance with claim 14, wherein the balance valve (20) is made as a valve cartridge with a conical valve seat.

18. The crane in accordance with claim 14, wherein the overload protection (18) further includes an on/off valve (22) in the control pressure line between the proportional pressure-relief valve (21) and the balance valve (20) to block the application of hydraulic pressure to the balance valve (20) it is in a non-controlled state.

19. The crane in accordance with claim 1: the overload protection (18) has further includes:

a hoist rope force sensor (13) that is coupled to the control device (10); and a proportional pressure-relief valve (21) that is connected between a hydraulic pressure source and the control pressure line to provide a controlled hydraulic pressure to the balance valve (20);

wherein the control device (10) in dependence on the respectively detected hoist rope force and a desired hoist rope retention force controls the proportional pressure-relief valve (21) to output a desired hydraulic pressure on the control pressure line.

20. The crane in accordance with claim 19, wherein the balance valve (20) in the open state short circuits the first and second hydraulic Ports of the hoist winch drive motor (9) resulting in the same hydraulic pressure being applied to both ports.

21. The crane in accordance with claim 19, wherein the balance valve (20) is made as a valve cartridge with a conical valve seat.

22. The crane in accordance with claim 19, wherein the overload protection (18) further includes an on/off valve (22) in the control pressure line between the proportional pressure-relief valve (21) and the balance valve (20) to block the application of hydraulic pressure to the balance valve (20) it is in a non-controlled state.

23. The crane in accordance with claim 1, wherein the balance valve (20) in the open state short circuits the first and second hydraulic input ports of the hoist winch drive motor (9) resulting in the same hydraulic pressure being applied to both ports.

24. The crane in accordance with claim 23, wherein the balance valve (20) is made as a valve cartridge with a conical valve seat.

25. The crane in accordance with claim 23, wherein the overload protection (18) further includes an on/off valve (22) in the control pressure line between the proportional pressure-relief valve (21) from and the balance valve (20) to block the application of hydraulic pressure to the balance valve (20) it is in a non-controlled state.

26. the crane in accordance with claim 1, wherein the balance valve (20) is made as a valve cartridge with a conical valve seat.

27. The crane in accordance with claim 26, wherein the overload protection (18) further includes an on/off valve (22) in the control pressure line between the proportional pressure-relief valve (21) and the balance valve (20) to block the application of hydraulic pressure to the balance valve (20) it is in a non-controlled state.

28. The crane in accordance with claim 1, wherein the overload protection (18) further includes:

a radius detection device (14) to provide a signal corresponding to the radius of the crane to the control device (10); and a load detection device (11) to provide a signal corresponding to the load on the crane to the control device (10);

wherein the control device (10) utilizes the radius and load information to control the hoist rope winch (7) to maintain a desired retention force on the hoist rope (5).

29. The crane in accordance with claim 1, wherein:

a base of the crane is mounted on a fixed platform (2); and the overload protection (18) further includes:

a radius detection device (14) to provide a signal corresponding to the radius the crane to the control device (10); and a hoist rope length sensor (17) to provide a signal corresponding to the length of hoist rope (5) played out by the hoist rope winch (7);

control device (10) utilizes the radius and played out length of hoist rope (5) to determine if lifting hook (6)is below the base of the crane.

* * * * *